US008123057B2

(12) United States Patent
Künz et al.

(10) Patent No.: US 8,123,057 B2
(45) Date of Patent: Feb. 28, 2012

(54) SECURITY ROTATING CLOSURE FOR A MULTI-COMPARTMENT BOTTLE INCLUDING CONICAL SEALS

(75) Inventors: Johann Künz, Hard (AT); Thomas Zauser, Bregenz (AT)

(73) Assignee: Alpha-Werke Alwin Lehner GmbH & Co KG, Hard (AT)

( * ) Notice: Subject to any disclaimer, the term of this patent is extended or adjusted under 35 U.S.C. 154(b) by 1226 days.

(21) Appl. No.: 10/592,128

(22) PCT Filed: Feb. 18, 2005

(86) PCT No.: PCT/EP2005/001680

§ 371 (c)(1),
(2), (4) Date: Jul. 17, 2007

(87) PCT Pub. No.: WO2005/087604

PCT Pub. Date: Sep. 22, 2005

(65) Prior Publication Data

US 2007/0278174 A1 Dec. 6, 2007

(30) Foreign Application Priority Data

Mar. 11, 2004 (CH) ..... 406/04

(51) Int. Cl.
*B65D 41/04* (2006.01)

(52) U.S. Cl. ..... 215/216; 215/218; 215/221

(58) Field of Classification Search ..... 215/211, 215/214, 208, 216–225

See application file for complete search history.

(56) References Cited

U.S. PATENT DOCUMENTS

| | | | | | |
|---|---|---|---|---|---|
| 3,729,553 | A | * | 4/1973 | Gold et al. | 424/44 |
| 4,520,921 | A | * | 6/1985 | Vissing | 206/1.5 |
| 4,752,014 | A | * | 6/1988 | House et al. | 215/216 |
| 4,948,002 | A | * | 8/1990 | Thornock et al. | 215/221 |
| 5,152,432 | A | * | 10/1992 | De Laforcade | 222/145.1 |
| 5,230,433 | A | * | 7/1993 | Hamilton et al. | 215/221 |
| 5,392,947 | A | * | 2/1995 | Gentile | 220/665 |
| 5,398,846 | A | * | 3/1995 | Corba et al. | 222/1 |
| 5,449,077 | A | * | 9/1995 | Seidler | 215/216 |
| 5,551,582 | A | * | 9/1996 | Robinson | 215/216 |
| 5,564,580 | A | * | 10/1996 | Hamilton et al. | 215/209 |
| 5,603,421 | A | * | 2/1997 | Opresco | 215/217 |
| 5,687,863 | A | * | 11/1997 | Kusz | 215/216 |
| 5,706,963 | A | * | 1/1998 | Gargione | 215/219 |
| 5,722,546 | A | * | 3/1998 | Briere | 215/216 |
| 5,735,417 | A | * | 4/1998 | Darr et al. | 215/216 |
| 5,765,705 | A | * | 6/1998 | Deubel | 215/216 |

(Continued)

FOREIGN PATENT DOCUMENTS

WO WO 02087984 A1 * 11/2002

*Primary Examiner* — J. Gregory Pickett
*Assistant Examiner* — Ned A Walker
(74) *Attorney, Agent, or Firm* — Buchanan Ingersoll & Rooney PC

(57) ABSTRACT

A safety rotating closure for a multi-compartment bottle including a two-chamber bottle with a separate pour neck with a pour opening for each chamber and a rotating closure which can be screwed onto a common neck part of the multi-compartment bottle and is provided with a mechanically acting child safety device against unauthorized loosening of the rotating closure. The rotating safety closure has essentially conical seal parts which in the screwed-on state engage the pour openings of the pour necks and interact with the inside walls to form a seal. The interlocking elements of the child safety device are located on the rotating safety closure.

25 Claims, 7 Drawing Sheets

U.S. PATENT DOCUMENTS 5,865,330 A * 2/1999 Buono ..... 215/216
5,908,125 A * 6/1999 Opresco ..... 215/216
5,934,515 A 8/1999 Bennett
5,938,086 A * 8/1999 Gross ..... 222/494
6,036,036 A * 3/2000 Bilani et al. ..... 215/216
6,082,588 A * 7/2000 Markey et al. ..... 222/137
6,296,130 B1 * 10/2001 Forsyth et al. ..... 215/219
6,321,947 B2 * 11/2001 Gross et al. ..... 222/145.1
6,357,615 B1 * 3/2002 Herr ..... 215/216
6,398,077 B1 * 6/2002 Gross et al. ..... 222/145.1
6,550,647 B1 * 4/2003 Kunz ..... 222/129
6,609,637 B1 * 8/2003 Suffa ..... 222/545
6,640,999 B2 * 11/2003 Peterson ..... 222/135
6,669,048 B2 * 12/2003 Eva et al. ..... 220/524
6,672,487 B1 * 1/2004 Lohrman ..... 222/213
6,786,363 B1 * 9/2004 Lohrman ..... 222/213
6,854,619 B2 * 2/2005 Knickerbocker ..... 222/1
6,866,164 B2 * 3/2005 Branson et al. ..... 222/153.14
7,007,523 B2 * 3/2006 Belden, Jr. ..... 70/57.1
7,090,097 B1 * 8/2006 Kazarian et al. ..... 222/144.5
7,100,785 B1 * 9/2006 Suffa ..... 215/330
7,334,694 B2 * 2/2008 Suffa ..... 215/216
7,552,832 B2 * 6/2009 Suffa ..... 215/236
7,815,062 B2 * 10/2010 Suffa ..... 215/221
2001/0013523 A1 * 8/2001 Gross et al. ..... 222/94
2003/0173364 A1 9/2003 Eva et al.
2004/0182814 A1 * 9/2004 Suffa ..... 215/216
2005/0133475 A1 * 6/2005 Goto et al. ..... 215/237
2006/0180617 A1 * 8/2006 Suffa ..... 222/485
2006/0191804 A1 * 8/2006 Suffa ..... 206/219

* cited by examiner

SECURITY ROTATING CLOSURE FOR A MULTI-COMPARTMENT BOTTLE INCLUDING CONICAL SEALS

BACKGROUND

A safety rotating closure is disclosed for a multi-compartment bottle, for example, a two-chamber bottle, with a separate pour neck.

In the household and in a commercial-industrial application, substances are often used which consist of separate components. For example, the substances are detergents or gardening agents or also agricultural agents which consist of at least two flowable or liquid individual components which must be stored separately from one another and come into contact with one another only when poured out. In this connection it is necessary to house the individual components in a standard container which has several chambers. For this purpose multi-compartment bottles, especially of plastic, which are produced in one or more parts, are known from the prior art.

To prevent the individual components from coming into contact with one another too early, in addition to multi-compartment bottles with a common pour opening for the chambers there are also multi-compartment bottles, conventionally two-chamber bottles which have a separate pour neck with its own pour opening for each chamber. Providing the separate pour openings with separate closures, for example rotating closures, is known.

U.S. Pat. No. 5,934,515 discloses a two-chamber bottle which has two separate pour openings. Each pour opening is provided with a separate closure. The closures are mounted on a platform which can be slipped onto the pour necks. Finally there is an overcap which can be placed over the pour neck provided with the closure platform.

US 2003/0173364 A1 describes a canister-like, two-chamber container which has a pour neck with two pour openings. The outside wall of the common pour neck is provided with an external thread. After attaching separate closure stoppers for the pour openings, a screw cap can be screwed onto the common pour neck.

Due to the often basic or acid contents of the multi-compartment bottles or in the case of other problematical contents, there is often the desire to seal these bottles child-proof. Therefore fundamentally any individual rotating closure can be provided with a child safety. In any case this approach is not extremely user-friendly in application. Therefore, the prior art discloses a sealing cap for a multi-compartment bottle, especially for a two-chamber bottle which can be screwed onto the common bottle neck of the multi-compartment bottle. The rotating closure has a sealing membrane which is located within the closure which is pressed against the edges of the mouth of the pour openings when the closure is screwed on. Sealing of the pour openings via the sealing membrane is unfortunately often simply unsatisfactory. When the rotating closure is screwed on and off, the opening edges rub against the sealing surface of the sealing membrane. In this way the sealing membrane can wear and then no longer closes correctly. The child safety feature of this known rotating closure consists in positive locking of interlocking elements located on the closure with the correspondingly made counterparts on the bottle neck. This dictates that bottles which are to be provided with a childproof closure must be produced separately.

SUMMARY

For reasons of production engineering and to keep costs low, it would be desirable if the same multi-compartment bottle could be used on the one hand for filling with safe contents and on the other for those contents which require a child-safety closure.

One object of Applicants' disclosure is to eliminate the disadvantages of safety rotating closures for multi-compartment bottles, especially of two-chamber bottles. A safety rotating closure will be devised which even after repeated opening and closing reliably seals the pour openings. Handling of the safety rotating closure should nevertheless be simple and self-explanatory. In this connection, the closure should have a simple structure and should be economical to produce. The necessity of producing a separate bottle series for use of the safety rotating closure will be eliminated.

Applicants have disclosed a safety rotating closure for a multi-compartment bottle, especially for a two-chamber bottle with separate pour necks. For example, Applicants have disclosed a safety rotating, closure for a multi-compartment bottle, especially a two-chamber bottle, which has a separate pour neck with a pour opening for each chamber and has a rotating closure which can be screwed onto a common neck part of the multi-compartment bottle. The safety rotating closure is provided with a mechanically acting child safety means against unauthorized loosening of the closure and has essentially conical seal parts which in the screwed-on state engage the pour openings of the pour necks and interact with the inside walls of the pour necks to form a seal. All the interlocking elements of the child safety means can be located on the safety rotating closure.

By providing conical seal parts the problem of abrasive wear of the sealing membranes or similar disk-shaped seal elements is eliminated. The conical seal parts slide axially in the pour openings and are pressed by closing pressure against the inside walls of the pour neck. When the closure is loosened, the conical seal parts slide again axially out of the pour openings. The danger of abrasive wear of the sealing surfaces and the opening edges is eliminated. By all the interlocking elements of the child safety means being located on the safety rotating closure, the necessity of separate bottle production with interlocking elements located on the bottle neck is eliminated. Whether the bottle must be equipped with a safety rotating closure is decided first of all based on the components to be added. The production of the type of multi-compartment bottle is largely independent thereof. At bottle manufacturers this leads to a reduction of the required molding tools. The numbers of multi-compartment bottles affected can be distinctly increased; this greatly benefits the economic efficiency of production.

The combination of a safety rotating closure with conical seal parts is implemented in one embodiment by a two-part structure. In this connection the safety rotating closure is composed of an overcap and a sealing insert. The overcap has a cover surface and a cylinder wall projecting from it, with an inner surface provided in areas with threaded sections. The sealing insert is pivotally held to be axially movable in the overcap. The conical seal parts project down from the bottom of the sealing insert facing away from the cover surface of the overcap. The separate sealing insert increases the flexibility of the safety rotating closure. In particular, depending on the type of contents of the multi-compartment bottle it is possible to insert sealing inserts of different materials into the overcap. Depending on the size of the exit openings sealing inserts with differently dimensioned seal parts can be inserted into the overcap. The overcap can be produced for example as a standard part which can be screwed onto a multi-compartment bottle with the correspondingly standard diameter of the common neck part. Depending on whether the multi-compartment bottle is a two-chamber or for example a three-chamber bottle, a corresponding sealing insert with two or three seal parts projecting from the bottom can be inserted into the overcap. In this way the overcap can be produced in a much larger number; this also greatly increases the economic efficiency of cap production.

One exemplary embodiment of the safety rotating closure calls for the safety parts to be formed from two projections on the overcap and two corresponding locking cams on the sealing insert. The two projections protrude down from opposing sections of the inner surface of the cylinder wall and are curved in a hook shape in the direction of the cover surface of the overcap. They are located at an axial distance from the cover surface which is larger than the axial height of the sealing insert. The two hook-shaped projections on the one hand axially support the sealing insert and on the other hand interact with the corresponding locking cams which protrude from the bottom of the sealing insert. During mounting the sealing insert is pressed simply into the overcap. In doing so it slides behind the hook-like projections which prevent it from falling out of the overcap again. The sealing insert lies axially and radially able to move freely in the overcap. When the safety rotating closure is screwed on, the sealing insert is turned at the same time until its conical seal parts slide into the pour openings. In this way further entrained turning of the sealing insert is prevented. Upon continued screwing down the overcap is turned relative to the sealing insert and is also moved axially relative to it in the direction of the bottle. Finally, the cover surface of the overcap adjoins the sealing part and presses the conical seal parts farther into the pour opening.

The locking cams are advantageously made wedge-shaped in the peripheral direction. The wedge-shaped locking cams facilitate the relative twisting capacity of the overcap and of the sealing insert when the safety ret rotating closure is being screwed on. In the opening direction the interacting locking cams and the hook-shaped projections block and prevent relative turning of the cover part in relation to the sealing insert. The locking of the safety rotating closure against opening results from preventing the relative turning of the cover part in relation to the sealing insert and the blocking action of the conical seal parts projecting into the pour opening.

To open the safety rotating closure, the rotating locking of the interacting projections and locking cams must be cancelled. This can take place in various ways. One advantageous version of the safety rotating closure calls for there to be projections on the inside surfaces of opposite tab sections of the overcap. The tab sections provided in the cylinder wall of the overcap can be radially adjusted elastically by pressure. By pressing together the tab sections the projections are moved to the inside and the locking cams can slide through the intermediate space between the cylinder wall and the projections which are curved in a hook shape. In this way the rotating locking is cancelled and the overcap can be turned relative to the sealing insert. As soon as the sealing insert rests on the projections of the overcap, it is lifted off the pour openings as the cap continues to be screwed on. As soon as the conical seal parts can slide out of the pour openings the sealing insert can again turn concomitantly with the overcap. It is no longer necessary to continue to press the tab sections together.

In order to better illustrate to the adult user the function of a safety rotating closure and to ensure better gripping of the overcap by the fingers, the tab sections are advantageously provided with ribbing at least in areas on their outside surfaces.

In order to facilitate placing the safety rotating closure on the multi-compartment bottle, in one advantageous embodiment of the safety rotating closure a centering pin located in the middle projects from the bottom of the sealing insert. With the cap in place the centering pin projects into the recess between the pour necks of the bottle and facilitates positioning. While the safety rotating closure is being screwed down the centering pin slides into the recess between the pour necks.

In another exemplary embodiment, the centering pin is hollow and is made to hold a guide pin which projects from the cover surface of the overcap. The guide pin improves the free location of the sealing insert in the overcap still further and prevents any tilting of the sealing insert.

Another exemplary embodiment of the safety rotating closure which likewise consists of only two parts which can be easily mounted to one another comprises an overcap which has a cover surface and a cylinder wall projecting from it, with an inside surface which is provided in areas with thread sections, and a sealing insert which is made essentially hat-shaped and held pivotally in the overcap. The conical seal parts project from the bottom of the hat-shaped sealing insert facing away from the cover surface of the overcap. The hat-like sealing insert has a rim-like edge section on which at least one locking cam is formed which interacts with at least one corresponding locking element of the overcap.

Each locking cam is made wedge-shaped in the rotating closing direction. This facilitates sliding of the locking elements of the overcap over the locking cams in the relative turning of the overcap and of the sealing insert in the rotating closing direction. Each locking cam in the opposite relative direction of rotation has a locking surface which forms an abutment for the locking element of the overcap.

To enhance the safety function of the safety rotating closure and to improve handling, it is advantageous if there are two locking cams which are made roughly diagonally opposite one another on the edge section of the sealing insert and which interact with a corresponding number of locking elements on the overcap. The corresponding locking elements on the overcap are formed by tab sections which are made integrally on the overcap and are radially and elastically adjustable by pressure.

To facilitate handling, the tab sections are provided on their outside with ribbing at least in areas.

As simple protection against the sealing insert's falling out of the overcap, the sealing insert in the overcap is supported on one or more projections which project out of the inner surface of the cylinder wall of the overcap and which has or have a shorter distance from the cover surface than the threaded sections. The projection or projections can be very easily produced integrally with the overcap. In installation, the sealing insert is easily pressed into the overcap until it slides over the projection or projections and is axially supported thereon.

In another exemplary embodiment, the sealing insert is held axially stationary in the overcap. This can take place for example by axially clamping the sealing insert between axially spaced projections in the overcap. But the hat-shaped sealing insert can have a height which corresponds essentially to the distance of the projection or projections from the cover surface of the overcap. After its installation the sealing insert strikes the cover surface of the overcap and thus can no longer be axially moved.

The axial immovability of the sealing insert makes it possible to provide a very simple version of an overtwist safety. The overtwist safety is formed by at least one wing section which is made on the rim-like edge section of the sealing insert. From the bottom of the wing section an extension projects axially such that the wing section can be elastically axially moved when the safety rotating closure is screwed onto the multi-compartment bottle and forms an abutment for the locking element made on the overcap, especially the tab section. As soon as the tab section hits the wing section which has been pressed up, further relative turning of the overcap in relation to the sealing insert is prevented. In this way the safety rotating closure can no longer be overtwisted.

The wing section is located in the rotating closing direction following the locking cam and has a distance from the locking cam which is greater than the width of the locking element measured in the peripheral direction, especially the width of the tab section on the overcap. In overshooting of the locking cam the tab section snaps back elastically into its initial position and ends up in the space between the locking cam and the wing section which has been pressed up. In this way, further relative movement of the overcap to the sealing insert in the rotary closing direction is hindered in the same manner as in the opposite rotary opening direction. The end point of unscrewing of the safety rotating closure is dictated by the arrangement of the vertically adjustable wing section. In this way the safety rotating closure can no longer be overtwisted. To open the safety rotating closure, the tab section must be pressed to the inside until its free end projects farther into the interior of the overcap than the locking cam. Only in this position are relative turning between the overcap and the sealing insert and thus unscrewing of the safety rotating closure enabled.

According to the exemplary arrangement of two tab sections and locking cams there are also two wing sections which are roughly diametrically opposite one another on the edge section of the sealing insert. In this way the prevention of over twisting is further improved and handling of the safety rotating closure is facilitated for reasons of symmetry.

A wing section can be produced especially easily by making one radially running notch and one notch which runs in the peripheral direction in the rim-like edge section. The resulting wing section is articulated to the edge section.

An exemplary safety rotating closure can be made for multi-compartment bottles with two or more chambers with separate pour necks and pour openings. In its most frequently used version the safety rotating closure is made for two-chamber bottles and has two opposite conical seal parts. For conventional cap sizes which can be comfortably grasped and actuated, there is enough space for two conical seal parts. The size of the seal parts is matched to the conventional dimensions of the pour openings of two-chamber bottles. Separate bottle production which is matched to the selected safety rotating closure is no longer necessary. For economical, large-scale production of the safety rotating closure the overcap and the sealing insert are made in a plastic injection molding process.

BRIEF DESCRIPTION OF THE DRAWINGS

Details of the exemplary safety rotating closure for a multi-compartment bottle may be learned from the description of the embodiments in conjunction with the drawings, wherein:

FIG. 2 shows a partially cut representation of an exemplary two-chamber bottle with the safety rotating closure screwed on;

DETAILED DESCRIPTION

Figure 1:
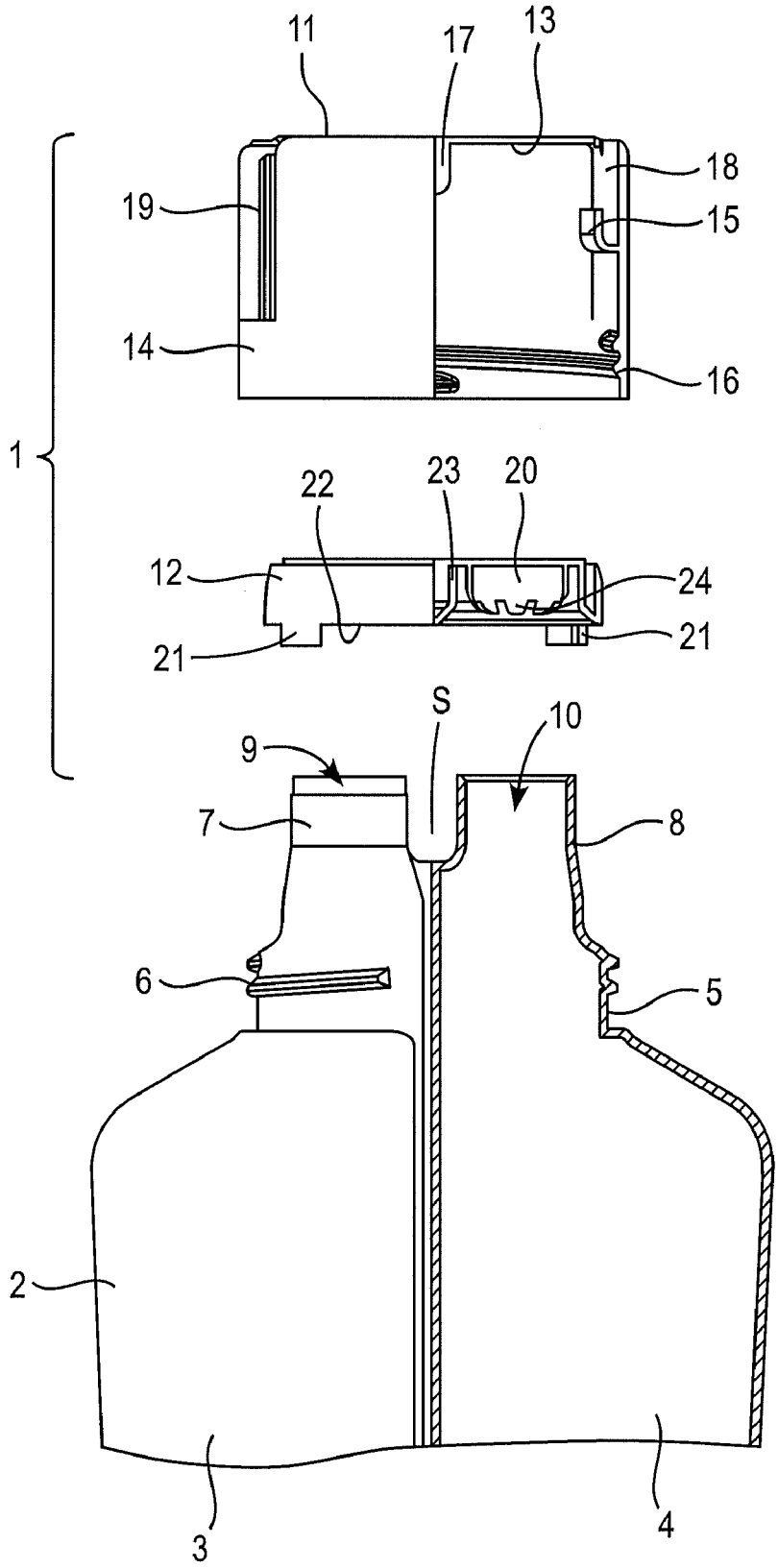
FIG. 1 shows a disassembled, partially cut representation of an exemplary safety rotating closure and a suggested two-chamber bottled.

FIG. 1 shows an exemplary multi-compartment bottle, for example, a two-chamber bottle 2 and a safety rotating closure labelled overall with reference number 1 in a disassembled representation. The two-chamber bottle 2 has two chambers 3, 4 which are separate from one another and which have separate pour necks 7, 8 with pour openings 9 and 10. The two pour necks 7, 8 pass toward the bottle body into a common neck part 5 which bears an outside thread 6. The free area between the two pour necks 7, 8 is provided with reference symbol S.

The safety rotating closure 1 has an overcap 11 and a sealing insert 12. From one cover surface 13 of the overcap 11 a cylinder wall 14 protrudes and is provided in its axial end area with an inside thread 16. The inside thread 16 of the overcap 11 and the outside thread 6 on the common bottle neck 5 are matched to one another. On the two opposite sections of the cylinder wall 14 projections 15 protrude which are curved in a hook shape and extend in the direction of the cover surface 13. The axial distance between the free ends of the projections 15 which are curved in a hook shape and the cover surface 13 is somewhat greater than the axial height of the sealing insert 12. The projections 15 are located on the tab sections 18 which each are formed by two axial and one radial notch in the cylinder wall 14 or in the cover surface 13 of the overcap 11. The tab sections 18 are made to be radially elastically resilient. On their outside the tab sections 18 are provided at least in areas with ribbing.

The sealing insert 12 on its bottom 22 is equipped with conical seal parts 20. The conical seal parts 20 have sealing ribs 24 separated from one another by notches. A centering pin 23 which is made hollow projects from the bottom 22 of the sealing insert 12. The overcap 11 and the sealing insert 12 can be produced in a plastic injection molding process from plastic, for example from polypropylene, polyethylene, HDPE, etc. To ensure the relative twisting capacity and axial mobility the overcap 11 and sealing insert 12 conventionally consist of different plastics. Alternatively they can also be provided with a slide coating on the slide areas.

Figure 2:
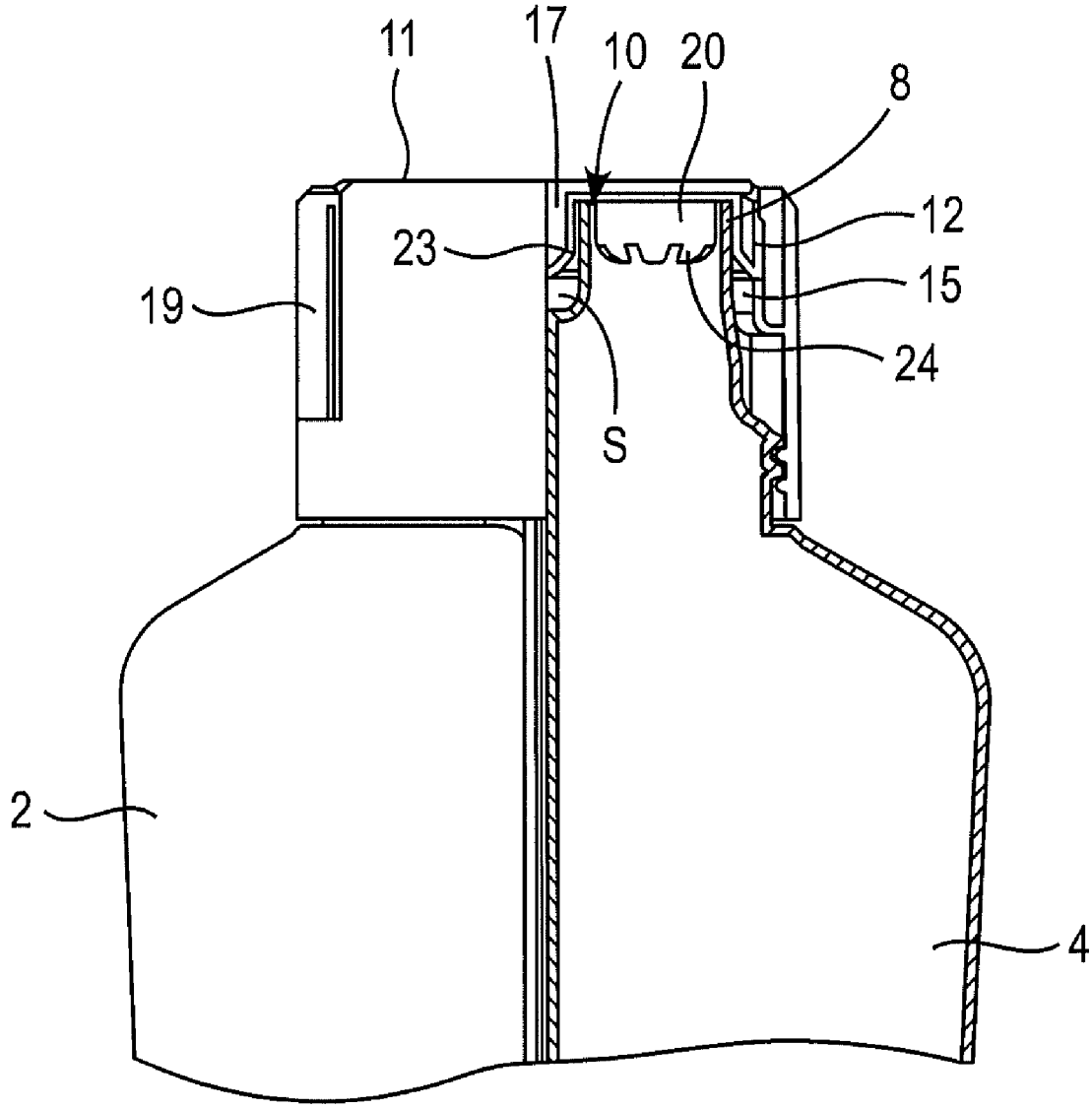

FIG. 2 shows an exemplary assembled safety rotating closure 1 in the screwed-on state. The sealing insert 12 is inserted into the overcap 11. In doing so its side wall slides over the hook-shaped projections 15 which prevent the sealing insert 12 from falling out again. The guide pin 17 of the overcap 11 projects into the hollow centering pin 23 of the sealing insert 12. In the screwed-on state of the safety rotating closure 1 the centering pin 23 projects into the free space S between the pour necks 8, 9 (FIG. 1) of the multi-compartment bottle 2. The conical seal part 20 projects into the pour opening 10 of the pour neck 8. Its sealing ribs 24 are sealed against the wall of the pour neck 8. As indicated in FIG. 2, the seal part 12 is pressed by the cover surface of the overcap 11 against the edges of the mouth of the pour openings 10.

Figure 3:
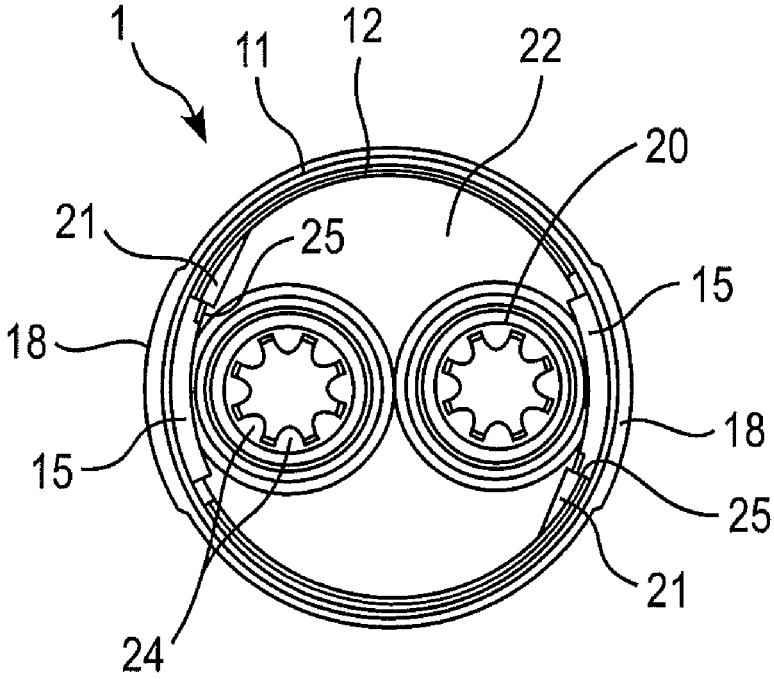
FIG. 3 shows a view into an exemplary safety rotating closure.

FIG. 3 shows a view into an exemplary assembled safety rotating closure. The illustrated version except for the lack of a centering pin of the sealing insert corresponds to the safety closure from FIGS. 1 and 2. It therefore likewise bears reference number 1 overall and the same parts are provided with the same reference numbers as in FIGS. 1 and 2. The sealing insert 12 is inserted into the overcap 11. The two projections 15 protruding from the cylinder wall of the tab sections 18 prevent the sealing insert 12 from falling out again. From the bottom 22 of the sealing insert 12 the two conical seal parts 20 project with the sealing ribs 24 separated from one another by notches. The locking cams 21 projecting from the bottom 22 of the sealing insert 12 in the peripheral direction have a wedge shape. The wedge shape in the rotating closing direction facilitates twisting of the overcap 11 relative to the seal part 12. In the opposite rotary opening direction, the locking cams 21 have wedge surfaces 25 which interact with the projections 15 by locking. It goes without saying that there can even be other arrangements of the locking cams on the sealing insert. While in the illustrated embodiment the locking cams 21 project from the bottom 22 of the sealing insert 12, in one alternative version the locking cams can also be located for example on the peripheral surface of the sealing insert or can project from the top of an annular flange which borders the sealing insert on its end section facing away from the cover surface of the overcap.

Figure 4:
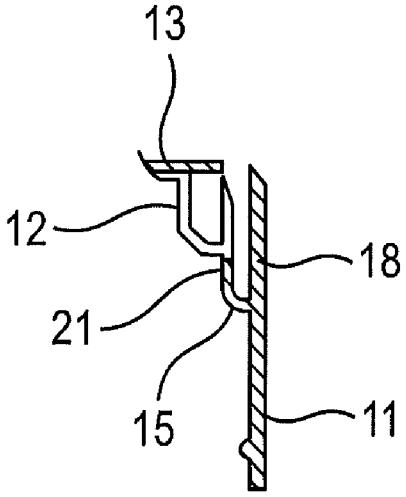
FIG. 4 and FIG. 5 show safety elements of the safety rotating closure in the locking and in the unlocked position.
Figure 5:
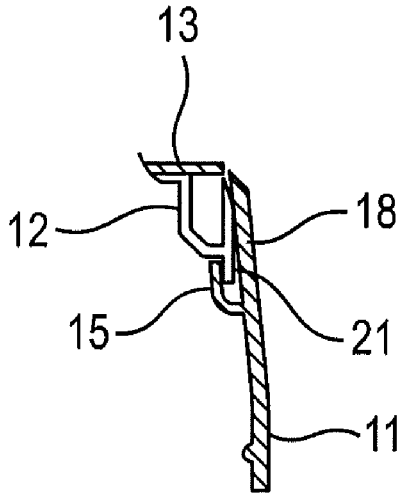

FIGS. 4 and 5 schematically show the locking and turning state of the interlocking elements of the safety rotating closure. In FIG. 4 the locking cam 21 of the sealing insert 12 locks against the projection 15 which is curved in a hook shape and which projects from the inside of the tab section 18 of the overcap 11. In this way twisting of the overcap 11 relative to the sealing insert 12 is prevented. The radial notch in the cover surface 13 of the overcap 11 for forming the elastically resilient tab section 18 is clearly apparent. FIG. 5 shows the state in which the locking of the interlocking elements is cancelled. The tab section 18 of the overcap 11 is pressed radially to the inside. In this way the locking cam 21 of the sealing insert 12 can slide into the intermediate space between the inside wall of the tab section 18 and the projection 15 which is curved in a hook shape and the overcap 11 can be twisted relative to the sealing insert 12.

Figure 6:
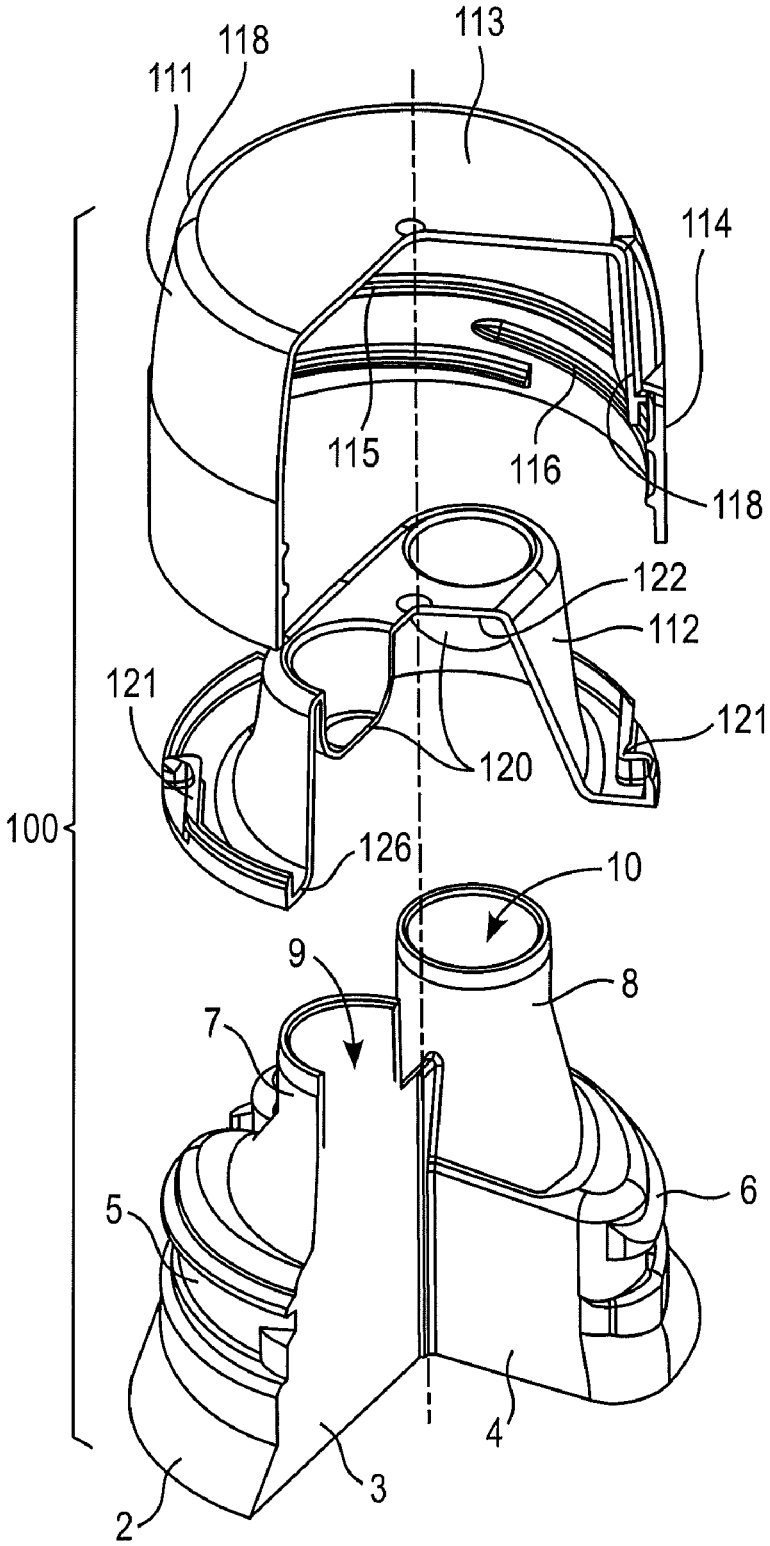
FIG. 6 shows a perspective, exploded and partially cut representation of another embodiment of the safety rotating closure with the suggested two-chamber bottle.

FIG. 6 shows an exploded perspective of another embodiment which is provided overall with the reference number 100. In the partially cut representation, the multi-compartment bottle, especially a two-chamber bottle, in turn bears reference number 2. The two-chamber bottle 2 has two chambers 3, 4 which are separate from one another and which have separate pour necks 7, 8 with pour openings 9 and 10. The two pour necks 7, 8 pass toward the bottle body into a common neck part 5 which bears an outside thread 6.

The safety rotating closure 100 has an overcap 111 and a sealing insert 112. From one cover surface 113 of the overcap 111 a cylinder wall 114 protrudes and is provided in its axial end area with an inside thread 116. The inside thread 116 on the overcap 111 and the outside thread 6 on the common bottle neck 5 are matched to one another. From the inside cylinder wall a peripheral projection 115 protrudes which is axially supported in the mounted state of the sealing insert 112. The peripheral projection 115 has a shorter distance from the cover surface 13 than the threaded sections of the inside thread 116. The overcap 111 is provided with two tab sections 118 which are each formed by two axial notches in the cylinder wall 114. The tab sections 118 are made radially elastically resilient. On their outside the tab sections 118 are provided at least in areas with ribbing.

The sealing insert 112 has essentially the shape of a hat and is equipped with conical seal parts 120 which project from its bottom 122. A rim-like edge section 126 of the sealing insert 112 is provided with two locking cams 121 which are roughly diametrically opposite one another. The locking cams 121 are made roughly wedge-shaped in the rotary closing direction.

The overcap 111 and the sealing insert 112 can be produced in a plastic injection molding process from plastic, for example from polypropylene, polyethylene, HDPE, etc. To ensure a relative twisting capacity, the overcap 111 and sealing insert 112 conventionally consist of different plastics. Alternatively they can also be provided with a slide coating on the slide areas.

Figure 7:
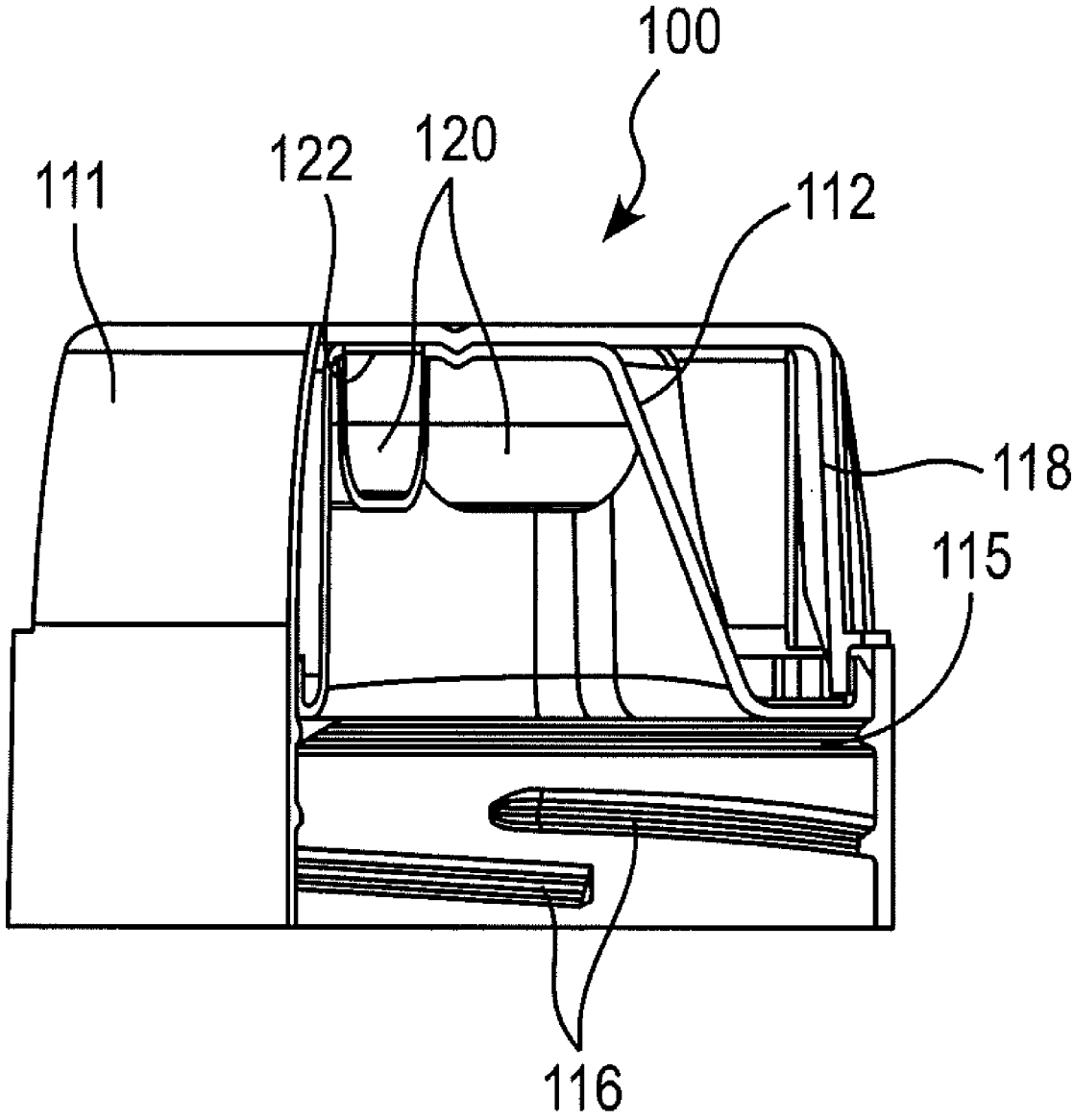
FIG. 7 shows the assembled safety rotating closure from FIG. 6 in a partially cut representation.

FIG. 7 shows the safety rotating closure 100 in the mounted state in which the sealing insert 112 is axially supported on the peripheral projection 115 on the overcap 111. It goes without saying that the projection 115 need not be completely peripheral. For the axial support function, spot projections located on a peripheral circle are also adequate. For example there can also be only three projections which are distributed, e.g., equidistantly over the peripheral circle. The conical seal parts projecting from the bottom 122 of the sealing insert 112 are in turn provided with reference number 120. A tab section formed on the overcap 111 is indicated at 118. The inside thread sections bear reference number 116.

Figure 8:
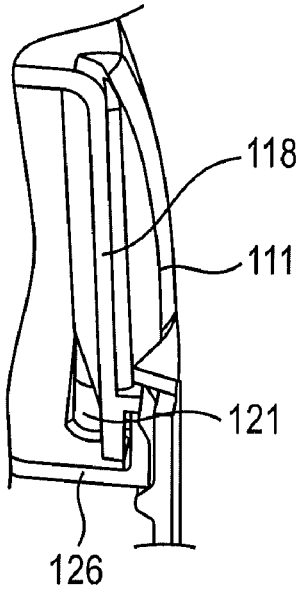
FIG. 8 and FIG. 9 show perspective detailed representations for explanation of the operation of the safety rotating closure as shown in FIGS. 6 and 7.
Figure 9:
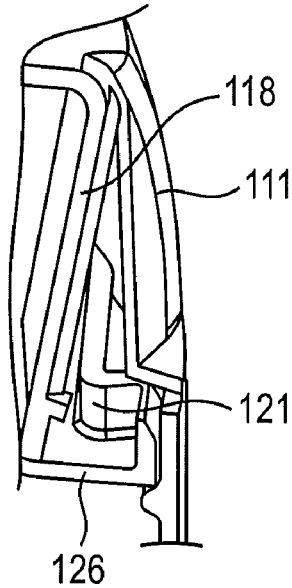

The safety function of the safety rotating closure 100 as shown in FIGS. 6 and 7 follows from the detailed representations of FIGS. 8 and 9 and FIGS. 10 and 11. The interlocking elements are formed by the locking cams 121 on the edge section 126 of the sealing insert and by the tab sections 118 of the overcap 111. When the safety rotating closure is screwed onto the two-chamber bottle the conical seal parts engage the pour openings of the pour necks. In this way the sealing insert is blocked and the overcap 111 is twisted relative to the sealing insert. Upon twisting, the tab sections 118 of the overcap 111 slide over the wedge-shaped locking cams 121. In doing so they are pressed radially to the inside. As soon as they have passed the locking cams 121, the tab sections 118 spring back into their initial position. This situation is shown in FIG. 8 and in FIG. 10. In an attempt to unscrew the safety rotating closure again, the tab sections 118 hit one locking surface 125 of the wedge-shaped locking cams 121, and opening of the safety rotating closure is prevented. To release the locking, the tab sections 118 must be pressed radially to the inside until they disengage from the locking surfaces 125 of the locking cams 121. This is shown in FIG. 9 and in FIG. 11.

Figure 10:
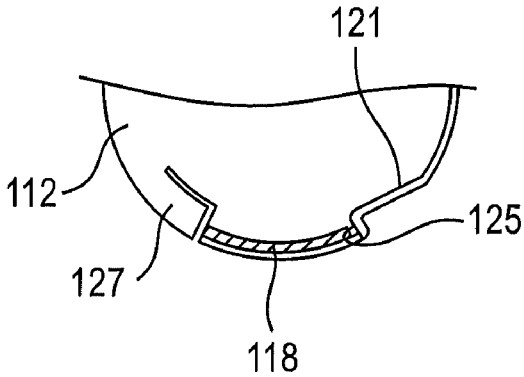
FIG. 10 and FIG. 11 show two schematic aspects for explanation of the operation of the safety rotating closure as shown in FIGS. 6 and 7.
Figure 11:
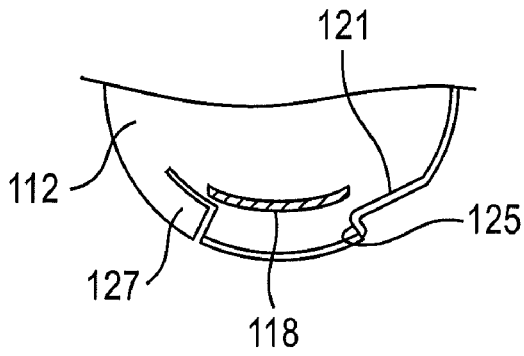

FIGS. 10 and 11 also show an overtwist safety labelled 127. The overtwist safety 127 is located on the edge section of the sealing insert 112 such that a tab section 118 which has sprung back into its initial position upon further rotary motion runs against an abutment and further rotation is prevented. The spacing of the overtwist safety 127 is slightly greater than the width of the tab section 118 measured in the peripheral direction.

Figure 12:
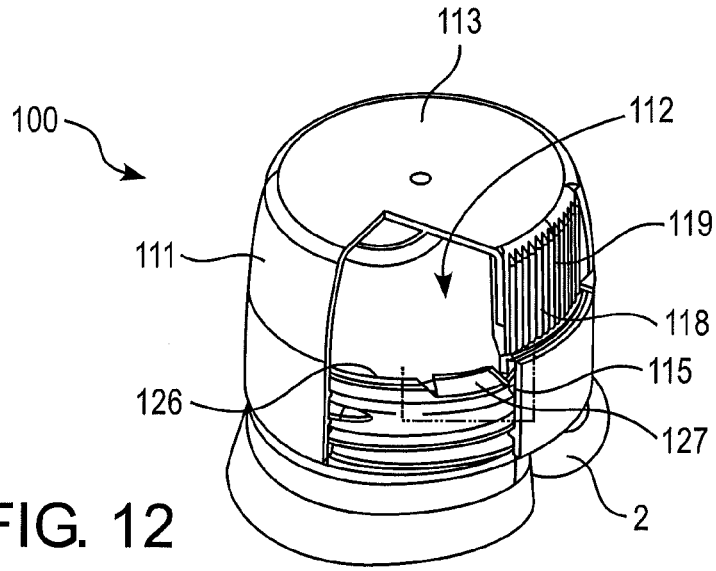
FIG. 12 shows a perspective and partially cut representation of the safety rotating closure as shown in FIGS. 6 and 7 with an overtwist safety.

FIG. 12 shows a partially cut perspective of the safety rotating closure 110 which is partially screwed onto a two-chamber bottle 2.

The safety rotating closure 100 in turn has an overcap 111 and a sealing insert 112 fixed axially in it. In particular, the sealing insert 112 has an axial height which corresponds to the distance of the annular projection 115 from the cover surface 113, which projection emerges from the inside surface of the overcap 111. A tab section which is provided with ribbing 119 and which is radially coupled movably to the overcap 111 in turn bears reference number 118. The safety rotating closure 100 is additionally provided with an overtwist safety 127. The overtwist safety 127 is made as an axially, elastically movable wing section which is produced by one radial notch and one notch which runs in the peripheral direction in the edge section 126 of the sealing insert 12? and is articulated to it.

Figure 13:
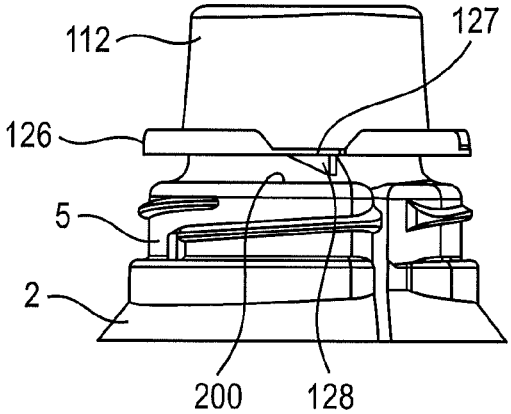
FIG. 13 and FIG. 14 show an exemplary two-chamber bottle with the sealing insert in place for explanation of the operation of the overtwist safety.
Figure 14:
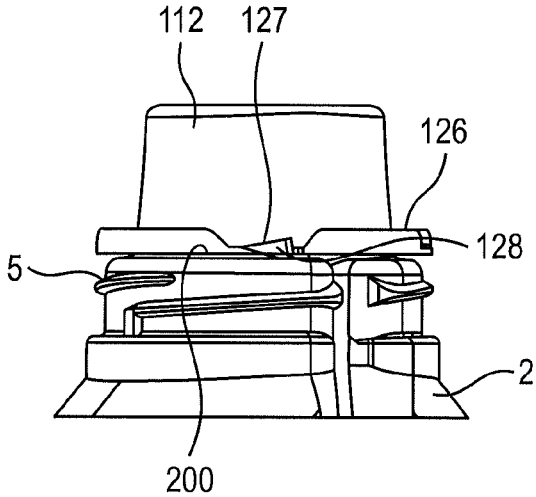

FIGS. 13 and 14 show only the sealing insert 112 placed on the neck part of the two-chamber bottle 2. The overtwist safety which is made as an axially elastic wing section on the edge section 126 of the sealing insert 112 is provided with reference number 127. An axial extension 128 protrudes from the bottom of the wing section 127 facing the neck part 5. The axial extension 128 is dimensioned such that when the safety rotating closure is screwed on, the extension comes into contact with a support surface 200 on the neck part 5 and deflects the wing section 127 axially up out of the plane of the edge section 126. The wing section 127 deflected into the interior of the overcap forms an abutment for the tab section which runs up in the relative twisting of the overcap and the sealing insert and prevents further twisting of the overcap in the closing direction. As already explained in FIGS. 10 and 11, the tab section is then caught between the locking cam and the wing section which has been pressed up (FIG. 10). The barrier can be neutralized again by pressing the tab section radially in (FIG. 11).

Figure 15:
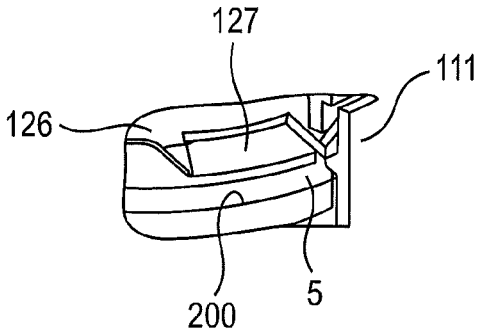
FIG. 15 and FIG. 16 show two exemplary representations of the safety rotating closure as shown in FIG. 12 for explanation of operation.
Figure 16:
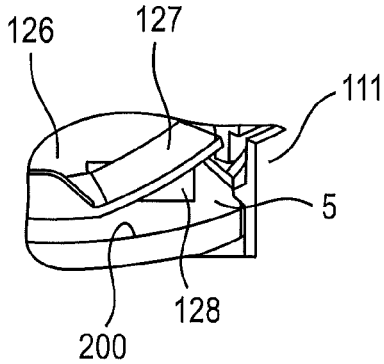

FIGS. 15 and 16 show exemplary representations of the overtwist safety 127 in its initial position (FIG. 15) and in the screwed-in state of the safety rotating closure (FIG. 16). The same parts bear the same reference numbers as in FIGS. 12-14. FIG. 16 shows that when the axial extension 128 runs onto the support surface 200 of the neck part 5 the wing section 127 is pressed out of the plane of the edge section 126 of the sealing insert into the interior of the overcap 111. There it forms a barrier against overtwisting of the overcap 111. While FIGS. 10-16 show only one overtwist safety 127 there can be two overtwist safeties which in the rotary closing direction are each located following the locking cams 121 on the edge section of the sealing insert 112.

The overcap and the sealing insert are advantageously produced in a plastic injection molding process.

The invention has been explained using the example of a two-chamber bottle. It will be appreciated by those skilled in the art that the present invention can be embodied in other specific form of a safety closure. For example, a safety closure with a sealing insert with a correspondingly modified number of conical seal parts and optionally overtwist safeties can also be used for containers with more than two chambers. Further, containers with three to four chambers and a corresponding number of pour necks with pour openings can be provided in this way with a rotating closure. The scope of the invention is indicated by the appended claims rather than the foregoing description and all changes that come within the meaning and range and equivalence thereof are intended to be embraced therein.

What is claimed is:

1. A bottle comprising:

a plurality of compartments;

a common neck part extending from the plurality of compartments and having a neck thread;

a separate pour neck for each compartment, each pour neck extending from the common neck part and including an interior wall and a pour opening;

a safety rotating closure assembly for providing a mechanically acting safeguard against tampering with the closure, the closure comprising:

an overcap having a cover surface and a cylindrical wall which projects from the cover surface, the cylindrical wall having an inside surface with threaded sections for screwing onto the neck thread of the common neck part of the bottle, and projections protruding from the inside surface which are curved in a hook-like manner in a direction of the cover surface;

a sealing insert held pivotally and able to move axially within the overcap, the sealing insert having substantially hemispherical seal parts, the hemispherical seal parts projecting from a bottom of the sealing insert which faces away from the cover surface of the overcap, wherein the hemispherical seal parts engage the interior walls of the respective separate pour necks to form a seal when the overcap is screwed onto the common neck part; and, wherein the projections are located on the inside surface of the cylindrical wall at an axial distance from the cover surface which is greater than or equal to an axial height of the sealing insert, and the projections axially support the sealing insert and interact with corresponding locking cams which protrude from the bottom of the sealing insert for safeguarding against tampering.

2. The bottle as claimed in claim 1, wherein the overcap is cup-shaped.

3. The bottle as claimed in claim 1, wherein the locking cams are made wedge-shaped in a rotary closing direction and in an opposite relative direction of rotation form an abutment for the projections.

4. The bottle as claimed in claim 1, comprising:

tab sections formed on opposing sections of the overcap; and projections on inside surfaces of the tab sections, which tab sections are radially adjustable elastically by pressure.

5. The bottle as claimed in claim 4, wherein outer surfaces of the tab sections have ribbing.

6. The bottle as claimed in claim 1, wherein a centering pin protrudes from a bottom center of the sealing insert.

7. The bottle as claimed in claim 6, wherein the centering pin is made hollow to accommodate a guide pin which protrudes from the cover of the overcap.

8. The bottle as claimed in claim 1, wherein the sealing insert is essentially hat-shaped.

9. The bottle as claimed in claim 8, wherein the hat-shaped sealing insert has a rim-like edge section on which the locking cams are formed which interacts with at least one corresponding projection of the overcap.

10. The bottle as claimed in claim 9, wherein each locking cam is made wedge-shaped in the rotary closing direction and in the opposite relative direction of rotation has a locking surface which forms the abutment for the locking element of the overcap.

11. The bottle as claimed in claim 10, wherein there are two locking cams which are made roughly diagonally opposite one another on the edge section of the sealing insert and the corresponding locking elements of the overcap are formed by tab sections which are made integrally on the overcap and are radially and elastically adjustable by pressure.

12. The bottle as claimed in claim 11, wherein the tab sections on their outside are provided at least in areas with ribbing.

13. The bottle as claimed in claim 9, wherein the sealing insert is held axially immovably in the overcap.

14. The bottle as claimed in claim 13, wherein there is an overtwist safety.

15. The bottle as claimed in claim 14, wherein the overtwist safety is formed by at least one wing section which is made on the rim-like edge section of the sealing insert, from its bottom an extension projects axially such that the wing section can be elastically moved axially when the safety rotating closure is screwed onto the bottle, and forms an abutment for the locking element which is made on the overcap.

16. The bottle as claimed in claim 15, wherein the wing section in the rotary closing direction is located following the locking cam and has a distance from the locking cam which is greater than the width of the locking element measured in the peripheral direction on the overcap.

17. The bottle as claimed in claim 16, wherein there are two wing sections which are roughly diametrically opposite one another on the edge section of the sealing insert.

18. The bottle as claimed in claim 15, wherein each wing section is formed by one radial notch and one notch which runs in the peripheral direction in the rim-like edge section of the sealing insert and is articulated to the edge section.

19. The bottle as claimed in claim 1, wherein the safety rotating closure has two hemispherical seal parts opposite one another.

20. The bottle as claimed in claim 1, wherein the overcap and the sealing insert are produced in a plastic injection molding process.

21. The bottle as claimed in claim 1, wherein a centering pin protrudes from a bottom center of the sealing insert.

22. The bottle as claimed in claim 4, wherein a centering pin protrudes from a bottom center of the sealing insert.

23. The bottle as claimed in claim 5, wherein a centering pin protrudes from a bottom center of the sealing insert.

24. The bottle as claimed in claim 1, wherein the bottle is a two-chamber bottle.

25. The bottle as claimed in claim 3, wherein a centering pin protrudes from a bottom center of the sealing insert.

* * * * *

UNITED STATES PATENT AND TRADEMARK OFFICE

CERTIFICATE OF CORRECTION

PATENT NO. : 8,123,057 B2
APPLICATION NO. : 10/592128
DATED : February 28, 2012
INVENTOR(S) : Johann Künz et al.

It is certified that error appears in the above-identified patent and that said Letters Patent is hereby corrected as shown below:

Title Page, Item (73) Assignee: change "Alpha-Werke Alwin Lehner GmbH & Co KG." to -- ALPLA-Werke Alwin Lehner GmbH & Co KG --.

Signed and Sealed this
Fourteenth Day of August, 2012

David J. Kappos

David J. Kappos
*Director of the United States Patent and Trademark Office*